US006171058B1

(12) United States Patent
Stec

(10) Patent No.: US 6,171,058 B1
(45) Date of Patent: Jan. 9, 2001

(54) SELF RETAINING BLADE DAMPER

(75) Inventor: Philip F. Stec, Medford, MA (US)

(73) Assignee: General Electric Company, Cincinnati, OH (US)

( * ) Notice: Under 35 U.S.C. 154(b), the term of this patent shall be extended for 0 days.

(21) Appl. No.: 09/283,429

(22) Filed: Apr. 1, 1999

(51) Int. Cl.[7] ..... B63H 1/16; B64C 11/16; F01D 5/22

(52) U.S. Cl. ..... 416/193 A; 416/500

(58) Field of Search ..... 416/193 A, 248, 416/500

(56) References Cited

U.S. PATENT DOCUMENTS 4,101,245 * 7/1978 Hess et al. ..... 416/193 A X
4,455,122 * 6/1984 Schwarzmann et al. .... 416/193 A X
4,568,247 * 2/1986 Jones et al. ..... 416/193 A X
5,052,890 * 10/1991 Roberts ..... 416/193 A
5,281,097 * 1/1994 Wilson et al. ..... 416/193 A
5,460,489 * 10/1995 Benjamin et al. ..... 416/248
5,478,207 * 12/1995 Stec ..... 416/500 X
5,730,584 * 3/1998 Dodd ..... 416/500 X
5,785,499 * 7/1998 Houston et al. ..... 416/248
5,803,710 * 9/1998 Dietrich et al. ..... 416/248
5,827,047 * 10/1998 Gonsor et al. ..... 416/193 A
5,924,699 * 7/1999 Airey et al. ..... 416/193 A X

OTHER PUBLICATIONS

General Electric Co., "Seal Strip Damper A," in commercial gas turbine engine use in USA for more than one year ago. General Electric Co.," Seal Strip Damper B," in a commercial gas turbine engine subject of a sales contract more than one year ago in the USA.

* cited by examiner

*Primary Examiner*—John E. Ryznic
(74) *Attorney, Agent, or Firm*—Andrew C. Hess; Rodney M. Young

(57) ABSTRACT

A turbine blade damper in the form of a sheet metal body includes a concave notch along one edge thereof, and a projecting side tab along an opposite edge thereof.

20 Claims, 3 Drawing Sheets

SELF RETAINING BLADE DAMPER

The US Government may have certain rights in this invention in accordance with Contract No. N00019-92-C-0149 awarded by the Department of the Navy.

BACKGROUND OF THE INVENTION

The present invention relates generally to gas turbine engines, and, more specifically, to turbine blade damping.

A gas turbine engine includes a turbine rotor or disk in which a plurality of circumferentially spaced apart turbine blades are supported around the perimeter. Each blade includes a hollow airfoil over which combustion gases flow during operation, with a platform being disposed at the root of the airfoil to define an inner boundary for the combustion gases. Extending radially below the platform is an integral shank and a corresponding dovetail therebelow. The dovetail may be configured as an axial-entry or a circumferential-entry dovetail, with the former being mounted in a complementary dovetail slot extending axially through the perimeter of the rotor disk.

During operation, the rotor disk is rotated by the extraction of energy from the hot combustion gases at the airfoils, and is therefore subject to vibration caused by rotation of the blades and aerodynamic loading of the airfoils. Blade vibration can occur at multiple natural frequencies, and corresponding modes, as excited by the speed of rotation and aerodynamic stimuli. Since a turbine operates over a range of rotary speed, different modes of vibration may be excited differently, and are therefore subject to different amounts of vibratory amplitude.

Accordingly, turbine rotor blades are specifically designed to minimize vibratory motion during operation while achieving a correspondingly long useful life. The high cycle fatigue strength of a turbine blade is one contributor to blade life, and is compromised when fatigue cracks appear near the end of blade life. High cycle fatigue cracks are initiated over the cumulative effect of vibratory motion of the blade during operation and typically occur in high stress regions of the blade, such as the airfoil, dovetail, or shank.

In order to improve the high cycle fatigue life of a turbine blade, vibration dampers are provided below the blade platforms to frictionally dissipate vibratory energy and reduce the corresponding amplitude of vibration during operation. A typical vibration damper is a thin sheet metal component having a trapezoidal profile which is loosely retained or trapped under adjoining platforms to bridge the axial splitline therebetween.

The damper is trapped radially between the adjacent platforms in corresponding pairs of lugs extending circumferentially outwardly from the opposing blade shanks. Under centrifugal force, the damper radially engages the underside of the blade platforms and conforms thereto for providing a frictional interface therebetween and a fluid seal at the splitline. The dampers are sized for achieving sufficient mass for effectively dissipating vibratory energy of the blades carried through the blade platforms.

However, the thin dampers must also be retained axially under the platforms to prevent undesirable liberation therefrom. An improved turbine blade vibration damper in the shape of an hourglass includes symmetrical, concave side notches extending longitudinally between a pair of opposite end tabs in a unitary sheet metal component. The symmetrical configuration of the damper permits its correct assembly between adjacent platforms in any one of the four possible installation orientations. When installed, one of the two side notches conforms with a corresponding convex bulge from the blade shank below the convex, suction side of the airfoil through which a cooling air passage extends radially from the airfoil and through the shank and dovetail for receiving cooling air during operation.

However, testing of this improved design has shown that under certain circumstances the thin damper may slide axially sufficiently to disengage the side notch from the shank bulge causing undesirable distortion of the damper, which in turn may lead to damage or liberation thereof.

Accordingly, it is desired to provide an improved turbine blade vibration damper having sufficient damping mass with self retention for preventing damage and liberation thereof during operation.

BRIEF SUMMARY OF THE INVENTION

A turbine blade damper in the form of a sheet metal body includes a concave notch along one edge thereof, and a projecting side tab along an opposite edge thereof.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
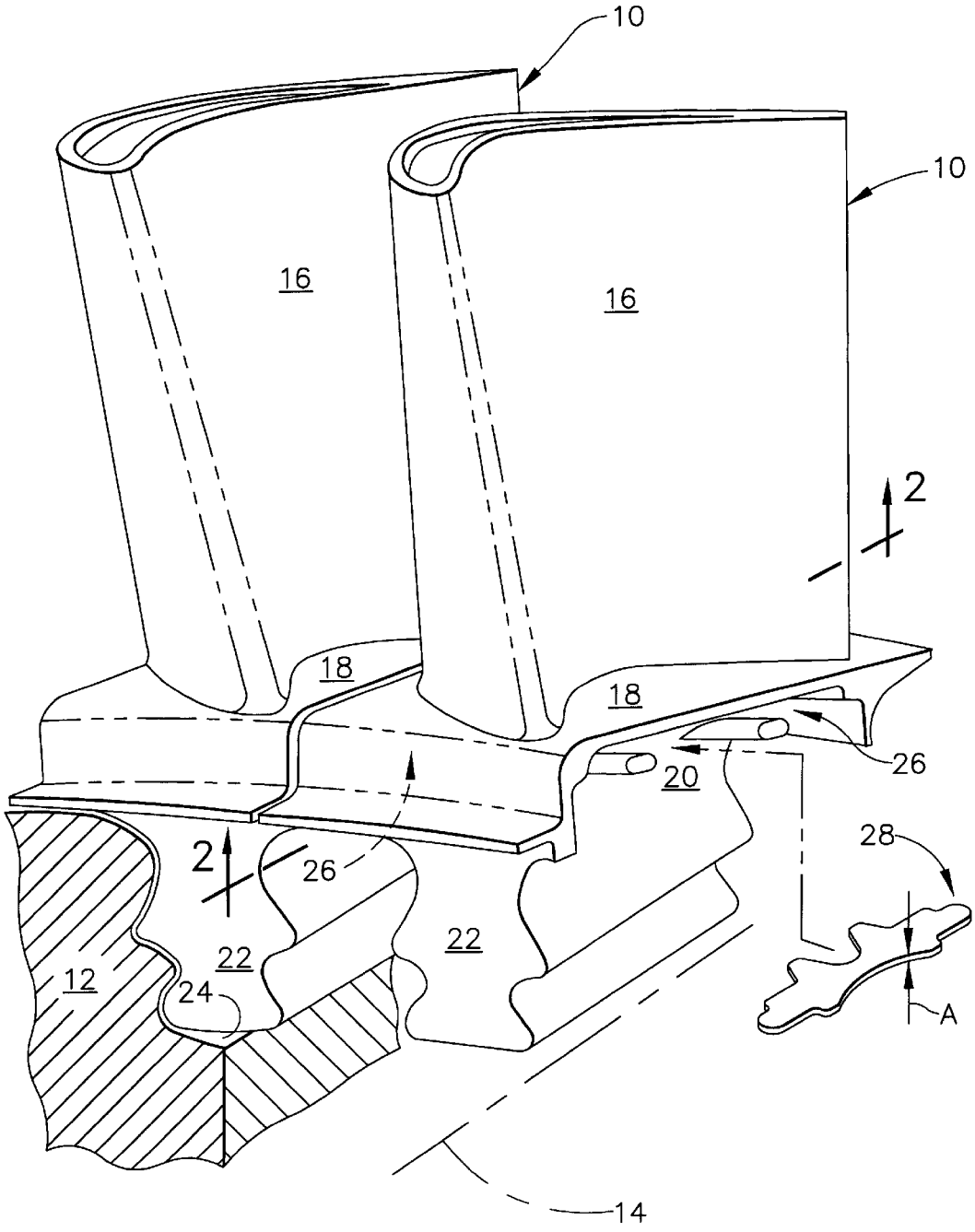
FIG. 1 is an isometric view of a pair of adjoining turbine rotor blades mounted to the perimeter of a rotor disk, and including vibration dampers therebetween in accordance with an exemplary embodiment of the present invention.

Illustrated in FIG. 1 is a pair of exemplary turbine rotor blades 10 mounted in the perimeter of a corresponding turbine rotor or disk 12, shown in part. The blades are two of many which circumferentially adjoin each other around the full circumference of the disk in a axisymmetrical configuration around the axial centerline axis 14 of the disk.

Each blade includes an airfoil 16, a platform 18, a shank 20, and an axial-entry dovetail 22 in a unitary, one-piece casting. The blade may have any conventional configuration, with the airfoil 16 having a generally concave, pressure side and an opposite, generally convex, suction side extending radially from root to tip and axially between corresponding leading and trailing edges. The platform is disposed at the airfoil root and defines a portion of the radially inner boundary of the combustion gases which flow over the airfoils during operation. The shank 20 extends radially inwardly from the platform and supports the dovetail 22 which in turn is mounted in a complementary dovetail slot 24 extending axially through the perimeter of the rotor disk.

During operation, energy is extracted from the combustion gases by the airfoils 16 which in turn rotate the disk 12 at a substantial rotary speed. The blades are therefore subject to vibratory excitation by the rotary speed of the disk and the aerodynamic loads over the airfoils. In order to dampen vibration of the blades during operation, corresponding pockets 26 are defined circumferentially between adjacent blade shanks 20 radially inboard of the adjoining platforms 18 in which are disposed corresponding seal strip vibration dampers 28.

In accordance with the present invention, the dampers 28 have an improved configuration for providing effective vibration damping during operation while additionally including self retention features therein. One of the dampers 28 is illustrated in FIG. 1 prior to assembly in its corresponding pocket 26 between adjacent blades. The damper 28 is preferably a unitary sheet metal component having a substantially constant thickness A of about 30 mils (0.76 mm) for example.

Figure 2:
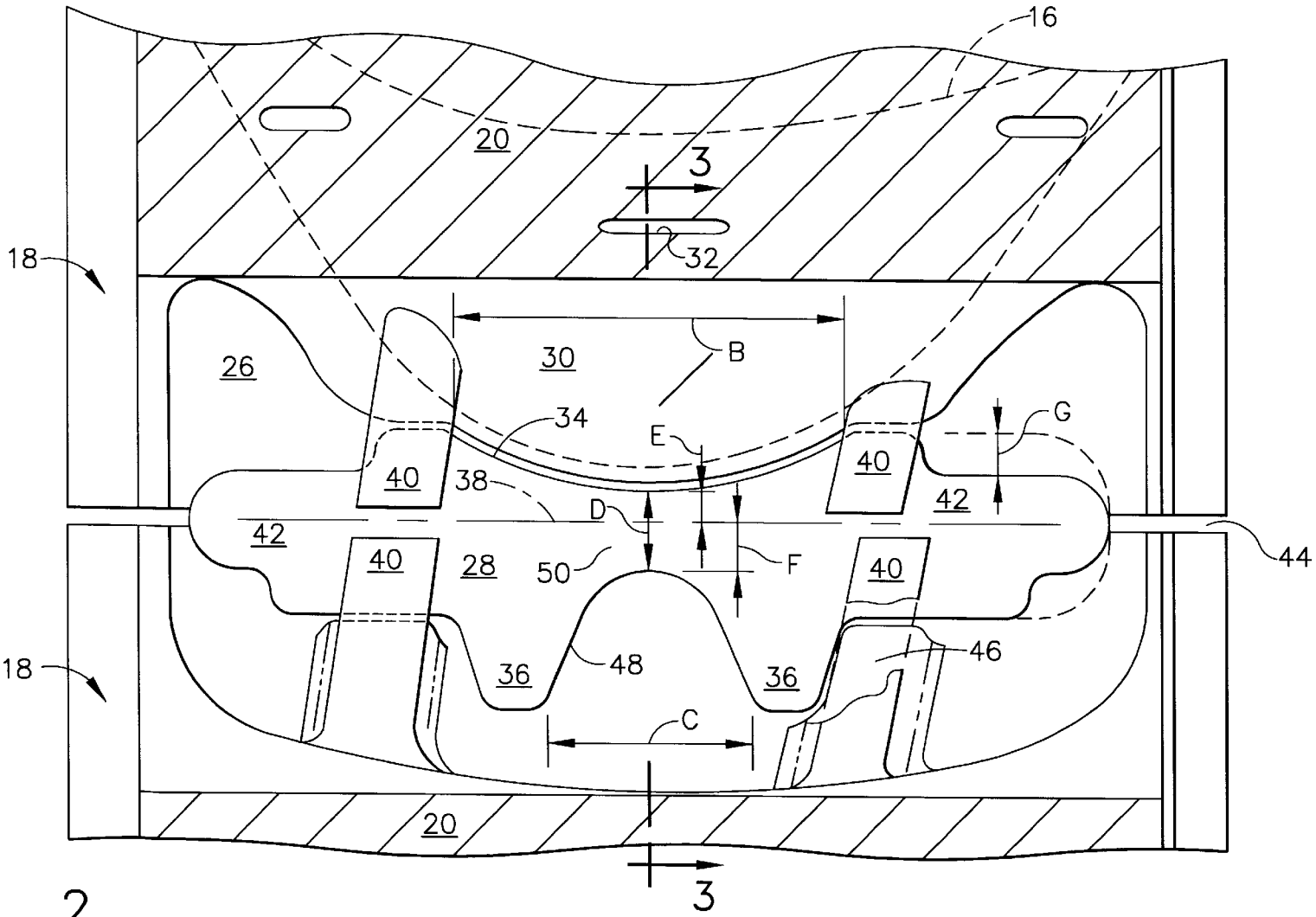
FIG. 2 is a radially outward planiform view of one of the vibration dampers illustrated in FIG. 1 mounted between adjacent turbine blades, and taken along line 2—2.
Figure 3:
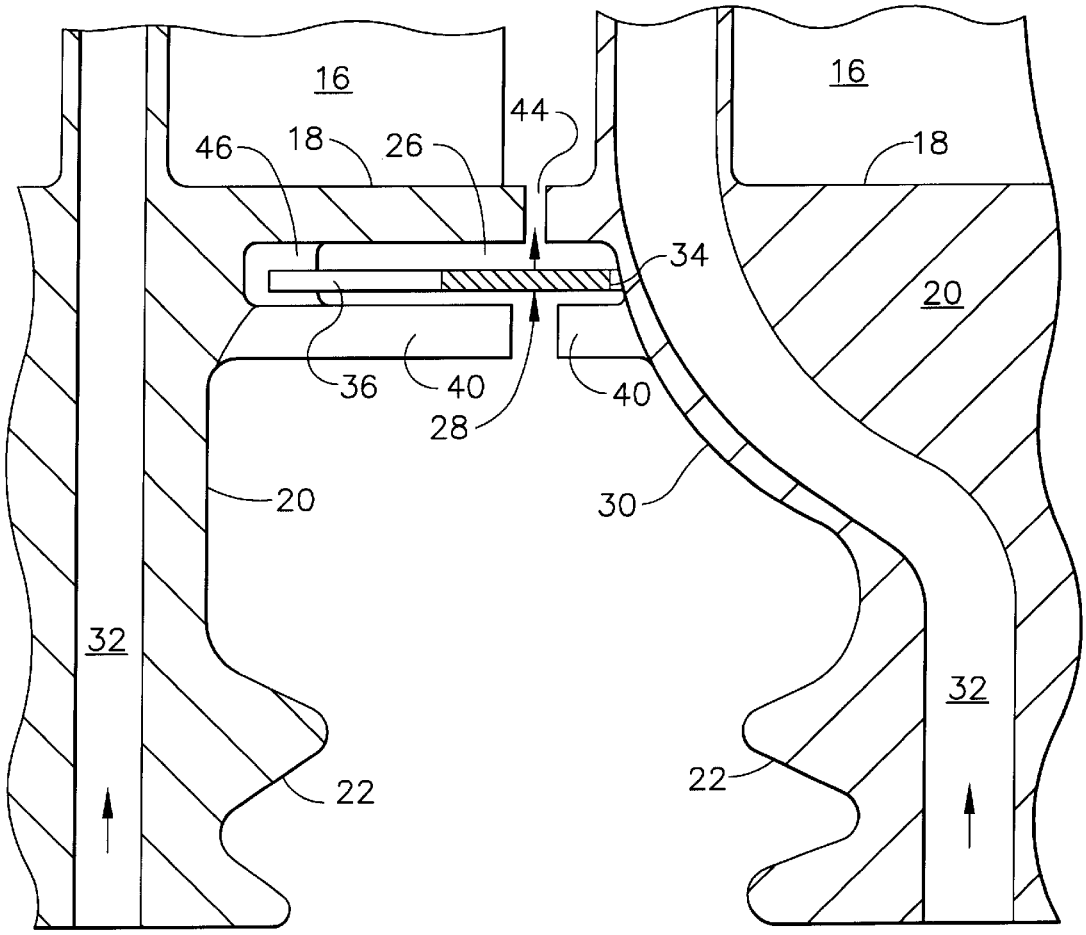
FIG. 3 is an elevational sectional view through a portion of the two turbine blades illustrated in FIG. 2 with the blade damper therebetween, and taken along line 3—3.

One of the dampers 28 is illustrated in more detail in FIGS. 2 and 3 installed between adjacent blades. Since the blade shank and dovetail are symmetrical and narrower than the corresponding platform and airfoil, a suitable transition must be provided therebetween. As shown in FIGS. 2 and 3, the convex side of the airfoil 16 projects circumferentially outwardly from the dovetail radially therebelow.

Accordingly, each blade shank 20 includes a generally convex hump or bulge 30 below the corresponding platform 18 radially inwardly of the airfoil convex side for providing a smooth blend or transition to the corresponding dovetail 22. The airfoils are hollow with one or more cooling passages 32 extending radially therethrough and through corresponding portions of the shank 20 and dovetail for receiving cooling air bled from the engine's compressor in a conventional manner. Since the pressure side of the blade airfoils is concave, the corresponding pressure sides of the blade shanks 20 do not require the transition bulge, and are generally straight in the radial direction.

The damper 28 illustrated in FIGS. 2 and 3 has a unitary sheet metal body with a first concave side notch 34 along a first edge thereof, and a first side tab 36 projecting outwardly or circumferentially along an opposite circumferential or lateral second edge.

As shown in FIG. 2, the damper body 28 includes a longitudinal axis 38 which extends in the general axial direction of the disk, and along which the circumferential side edges of the damper are coextensive from end-to-end of the damper. The side notch 34 extends along the damper longitudinal axis in the central or middle region thereof. And, the side tab 36 extends generally perpendicularly to the longitudinal axis 38 in the circumferential direction on the side of the axis 38 opposite to the side notch 34.

Each of the blade shanks 20 includes corresponding pairs of axially spaced apart posts or lugs 40 extending circumferentially outwardly therefrom on both circumferential sides of the shanks. As shown in FIG. 3, the lugs 40 are spaced radially inwardly from the inner surfaces of the corresponding platforms 18 for radially retaining and trapping a corresponding damper 28 therebetween.

More specifically, each damper 28 as illustrated in FIG. 2 includes a pair of distal end flats or tabs 42 disposed at opposite ends of the longitudinal axis 38. The side notch 34 is preferably disposed intermediate between the end tabs 42 at a middle position therebetween, with the side tab 36 adjoining one of the end tabs 42. The lugs 40 are axially spaced apart from each other in each pair to underlie corresponding ones of the end tabs 42 for radially trapping the end tabs between the lugs and the underside of the platforms.

Although lugs like those shown in FIG. 2 have been used in commercial service for many years in this country for radially trapping turbine blade dampers, their use alone is insufficient for preventing axial travel of a damper. However, by providing both the side notch 34 and side tab 36 in the specifically configured damper 28 illustrated in FIG. 2, axial self retention of the damper may be effected to prevent the inadvertent liberation thereof under centrifugal force.

More specifically, FIG. 3 illustrates the damper 28 in an initial position trapped by the lugs 40 while the rotor blades are not rotating. During rotation, however, centrifugal force forces the damper radially outwardly to engage the underside of the adjacent platforms 18 and conform thereto. The damper 28 must be suitability thin to conform to the platform undersides for providing a suitable seal for the axial splitline 44 therebetween. However, the damper must also be sized with sufficient mass, not too much nor too little, for effecting suitable frictional damping of blade vibration during operation.

As shown in FIGS. 2 and 3, each of the blade platforms 18 includes a radially inwardly extending ridge or rib 46 adjoining the base of an aft one of the lugs 40 on the shank pressure side for axially abutting the side tab 36 to restrain or prevent aft movement therepast. As shown in FIG. 1, the blade platform 18 is sloped radially inwardly from its forward edge at the airfoil leading edge to its aft end near the airfoil trailing edge. Since the platform has a relatively constant thickness over the damper pocket 26, the inner surface thereof also inclines radially inwardly in the aft direction, with the corresponding damper 28 assuming this inclination during operation.

In developing the damper 28 illustrated in FIG. 2, it was discovered that this exemplary damper has the tendency to move or slide in the aft direction even though the inclination of the platform 18 is radially inwardly in the aft direction in opposition to the component of centrifugal force acting on the damper 28 in the axially forward direction.

Accordingly, the side notch 34 is configured to complement or conform with the convex bulge 30 illustrated in FIG. 2 for providing axial retention along the suction side of the damper 28. And, the side tab 36 is disposed on the pressure side of the damper for axially abutting the rib 46 for axially retaining the damper on this side. In this way, the damper is axially self retained on both of its sides in two correspondingly different manners within the limited pocket 26 defined between the lugs 40 and the underside of the platforms 18. As the damper 28 moves radially outwardly to conform to the underside of the blade platforms during operation, the corresponding distortion thereof is insufficient to permit the damper to slide axially past either the bulge 30 or the stopping rib 46 thusly preventing axial liberation of the damper during operation.

As shown in FIG. 2, the damper 28 preferably includes a pair of the side tabs 36 spaced longitudinally apart along the second edge thereof to define a second concave notch 48 laterally or circumferentially opposite to the first notch 34.

The side tab pair 36 are preferably disposed laterally opposite to the first side notch 34, with the second side notch 48 being narrower than the first notch. The first notch 34 has a length B, and the second notch 48 has a corresponding length C. The first notch length is preferably longer than the second notch length, with the first notch being relatively shallow in depth, with the second notch being relatively deep.

Both the first and second notches 34,48 are preferably disposed at the middle of the damper on opposite sides thereof to define a corresponding neck 50 having a minimum lateral width D therebetween. Since the side tabs 36 extend laterally outwardly greater than the corresponding widths of the end tabs 42, they correspondingly increase the overall mass of the damper 28. The mass of the damper must be sufficient for effectively damping vibration during operation, but should not be excessive or vibration damping will decrease. The mass of the damper is controlled by its thickness and its area, with the damper being suitably long to cover a majority of the splitline 44 for providing sealing thereat during operation. By introducing the side tabs 36, the mass of the damper increases, but is offset by introducing the second side notch 48 therebetween to prevent excessive mass of the damper.

In the preferred embodiment illustrated in FIG. 2, the neck 50 extends perpendicular to the longitudinal axis 38 outwardly to the first and second notches 34,48, with a greater width portion F at the second notch 48 than at the first notch 34 having a width portion E. Since the damper may be installed correctly only with the first notch 34 adjoining the shank bulge 30, the neck width portion E is limited by the available space between the bulge and the splitline 44.

Since the opposite second notch 48 is introduced to reduce weight of the damper between the side tabs 36, it may also be used for providing additional width in the neck 50, with the width portion F on one side of the axis 38 being larger than the width portion E on the opposite side of the axis. In this way, the neck 50 may have a selectively increased cross sectional area and corresponding stiffness to prevent undesirable distortion or buckling of the damper thereat during operation. The neck 50 is selectively increased in stiffness while the second notch 48 reduces overall weight of the damper while also providing a relatively large fillet radius between the side tabs 36 for reducing stress concentration therebetween during operation.

In the preferred embodiment illustrated in FIG. 2, the damper body 28 is symmetrical across the neck 50 from forward-end-to-aft-end of the damper along the longitudinal axis 38. Correspondingly, the damper is nonsymmetrical side-to-side across the longitudinal axis 38 in the circumferential direction. In this way, of the four possible orientations of installing the damper 28 in it corresponding pocket 26, two of the orientations are correct, with two orientations being incorrect and not achievable in view of the nonsymmetry of the side notches 34,48.

Either end tab 42 may be positioned in the pocket 26 in the forward or aft direction, as long as the first notch 34 is disposed along the shank bulge 30. The configuration and height of the side tabs 36 prevent assembly of the damper with the side tabs 36 positioned along the shank bulge 30. Sufficient room for the side tabs 36 is provided solely on the shank pressure side which does not have the convex bulge 30. Although a single one of the side tabs 36 is sufficient for providing axial self retention of the damper against the stopping rib 46, the second side tab 36 is provided for symmetry and improving ease of assembly and Murphy proofing.

As shown in FIG. 2, the two end tabs 42 are laterally or circumferentially sized in width to circumferentially abut respective portions of the blade shanks at corresponding ones of the lugs 40 to circumferentially retain the damper therebetween. The bases of the individual lugs 40 extend outwardly from the corresponding blade shanks as illustrated in FIG. 3, and included portions, such as the ribs 46, which also extend to the underside of the platforms.

In this way, the circumferentially opposite sides of the end tabs 42 are trapped circumferentially between the opposite blade shanks and radially outwardly of the corresponding lugs 40. Any axial force exerted on the damper 28 during operation will be reacted through the one side tab 36 axially engaging the rib 46 for self retaining the damper against axial liberation. The side tabs 36 are sufficiently large for reacting the axial force during operation with reduced stress and without unacceptable distortion of the damper.

In view of the increased mass provided by the pair of side tabs 36, additional weight of the damper may be removed in the corresponding end tabs 42 to offset that increased weight. In the exemplary embodiment illustrated in FIG. 2, the end tabs 42 are recessed in width or depth G in part along the perimeters thereof between the first notch 34 and the side tabs 36. The end tabs 42 must be sufficiently wide at their bases near the first notch 34 and the side tabs 36 for bridging the width of the pocket between the opposite blade shanks outboard of the corresponding lugs 40. However, the end tabs 42 may have a reduced width axially therefrom selected to suitably cover the splitline 44 to provide an effective seal thereat during operation.

In view of the nonsymmetrical side-to-side configuration of the damper 28 illustrated in FIG. 2, the end tabs 42 are preferably recessed more along the perimeters thereof adjacent the first notch 34 than adjacent the side tabs 36. The end tabs 42 circumferentially adjoin the shroud bulge 30 at both ends of the first notch 34 in a symmetrical arrangement which permits a correspondingly large recession of the end tabs 42 to the distal ends thereof.

However, since only one of the side tabs 36 is configured to axially abut the rib 46, with that rib 46 additionally circumferentially abutting the corresponding base of the end tab 42, the second pressure-side lug 40 engages the corresponding end tab 42 further away from the adjacent end tab 36. The end tabs 42 must therefore have suitable axial extent for permitting installation of the damper 28 in either of its two end-to-end orientations with suitable self retention therein. The axial extent of the recession of the pressure sides of the end tabs 42 is thusly limited by the need to circumferentially abut the end tabs at two different relative positions due to the corresponding different positions of the pressure side lugs 40.

Although the damper 38 has been configured for a specific configuration of the adjoining blades, it may be suitably modified for different applications. For example, two ribs 46 may be used to adjoin respective ones of the two side tabs 36 for axially retaining the damper in both forward and aft directions. Or, the side tabs 36 and ribs 46 may be configured to axially retain the damper in either the forward or aft direction.

The improved damper 28 is preferentially contoured around its perimeter to introduce the side notch 34 and cooperating aft side tab 36 which collectively provide axial self retention of the damper in its pocket 26 cooperating with the shank bulge 30 and platform rib 46. The damper is preferably symmetrical end-to-end for permitting two correct installation orientations, with two Murphy-proofed incorrect installation orientations which prevent assembly. The additional damper mass provided by the side tabs 36 is selectively offset by introducing the second side notch 48 and the end tab recesses G while still providing effective sealing of the splitline 44. Additional damper stiffness is provided at the selectively widened neck 50 for improving the strength of the damper.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which I claim.

What is claimed is:

1. A turbine blade damper comprising a sheet metal body having a concave notch along a first edge, and a side tab projecting outwardly along an opposite second edge.

2. A damper according to claim 1 wherein said body includes a longitudinal axis, said notch extends along said longitudinal axis, and said side tab extends generally perpendicular to said longitudinal axis.

3. A damper according to claim 2 wherein said body includes a pair of end tabs disposed at opposite ends of said longitudinal axis, said notch is disposed intermediate therebetween, and said side tab adjoins one of said end tabs.

4. A damper according to claim 3 wherein said body further comprises a pair of said side tabs spaced longitudinally apart along said second edge to define a second concave notch opposite to said first notch.

5. A damper according to claim 4 wherein said side tab pair are disposed opposite to said first notch, with said second notch being narrower than said first notch.

6. A damper according to claim 4 wherein said first and second notches define a neck of minimum width therebetween.

7. A damper according to claim 6 wherein said neck extends perpendicular to said longitudinal axis outwardly to said first and second notches with a greater width portion at said second notch than at said first notch.

8. A damper according to claim 4 wherein said end tabs are recessed in part along perimeters thereof between said first notch and said side tabs.

9. A damper according to claim 8 wherein said end tabs are recessed more adjacent said first notch than adjacent said side tabs.

10. A damper according to claim 4 wherein said body is symmetrical across said neck from end-to-end along said longitudinal axis, and nonsymmetrical side-to-side across said longitudinal axis.

11. An apparatus comprising:

a pair of adjoining turbine blades mounted in a disk, with each blade having an airfoil, platform, dovetail, and a pocket defined between adjacent shanks inboard of said platforms; and a damper disposed in said pocket, and comprising a sheet metal body having a concave notch along a first edge, and a side tab projecting outwardly along an opposite second edge.

12. An apparatus according to claim 11 wherein:

said disk includes an axial axis; and said damper body includes a longitudinal axis, said notch extends along said longitudinal axis, and said side tab extends generally perpendicular to said longitudinal axis and generally circumferentially around said disk.

13. An apparatus according to claim 12 wherein:

said shanks include pairs of lugs extending circumferentially outwardly therefrom; and said damper body includes a pair of end tabs disposed at opposite ends of said longitudinal axis, said notch is disposed intermediate therebetween, and said side tab adjoins one of said end tabs, with said end tabs being radially trapped between said lugs and said platforms.

14. An apparatus according to claim 13 wherein:

each of said airfoils includes circumferentially opposite concave and convex sides, with each of said shanks having a convex bulge below said platforms inboard of said airfoil convex sides; and said damper body further comprises a pair of said side tabs spaced longitudinally apart along said second edge to define a second concave notch opposite to said first notch, and said first concave notch is complementary with said convex bulge.

15. An apparatus according to claim 14 wherein:

each of said blade platforms includes a radially inwardly extending rib adjoining a base of one of said lugs for axially abutting one of said side tabs to restrain movement therepast; and said side tab pair are disposed opposite to said first notch, with said second notch being narrower than said first notch.

16. An apparatus according to claim 15 wherein said first and second notches define a neck of minimum width therebetween.

17. An apparatus according to claim 16 wherein said neck extends perpendicular to said longitudinal axis outwardly to said first and second notches, with a greater width portion at said second notch than at said first notch.

18. An apparatus according to claim 17 wherein:

said end tabs are laterally sized to abut respective portions of said blade shanks at said lugs to circumferentially retain said damper therebetween; and said end tabs are recessed in part along perimeters thereof between said notch and said side tabs.

19. An apparatus according to claim 18 wherein said end tabs are recessed more adjacent said first notch than adjacent said side tabs.

20. An apparatus according to claim 19 wherein said damper body is symmetrical across said neck from end-to-end along said longitudinal axis, and nonsymmetrical side-to-side across said longitudinal axis.

* * * * *